US005572294A

United States Patent [19]

Osawa et al.

[11] Patent Number: 5,572,294

[45] Date of Patent: Nov. 5, 1996

[54] CONTACT CHARGER AND IMAGE FORMING APPARATUS PROVIDED WITH SAME

[75] Inventors: Izumi Osawa, Ikeda; Isao Doi, Toyonaka; Seishi Ojima, Takatsuki; Yoshihiro Uchimoto, Habikino, all of Japan

[73] Assignee: Minolta Co., Ltd., Osaka, Japan

[21] Appl. No.: 328,834

[22] Filed: Oct. 25, 1994

[30] Foreign Application Priority Data

Oct. 27, 1993 [JP] Japan ..... 5-269224

[51] Int. Cl.[6] ..... G03G 15/02

[52] U.S. Cl. ..... 399/174

[58] Field of Search ..... 355/219, 221, 355/225; 250/324, 325, 326

[56] References Cited

U.S. PATENT DOCUMENTS

| | | | |
|---|---|---|---|
| 4,922,299 | 5/1990 | Uchimoto et al. | 355/219 |
| 5,089,851 | 2/1992 | Tanaka et al. | 355/219 |
| 5,126,913 | 6/1992 | Araya et al. | 355/219 X |
| 5,140,371 | 8/1992 | Ishihara et al. | 355/219 |
| 5,146,281 | 9/1992 | Kisu | 355/219 |
| 5,270,768 | 12/1993 | Murata | 355/219 |
| 5,363,176 | 11/1994 | Ishihara et al. | 355/219 |
| 5,412,455 | 5/1995 | Ono et al. | 355/219 |

FOREIGN PATENT DOCUMENTS

| | | |
|---|---|---|
| 1-179957 | 7/1989 | Japan . |
| 1-191161 | 8/1989 | Japan . |
| 1-277257 | 11/1989 | Japan . |

*Primary Examiner*—Fred L. Braun

*Attorney, Agent, or Firm*—Burns, Doane, Swecker & Mathis, LLP

[57] ABSTRACT

A contact charging device which charges the surface of an electrostatic latent image carrying member rotating at a high speed by contacting a charging member to the surface of the image carrying member. The charging member has a conductive substrate, a conductive elastic layer superimposed over the conductive substrate and having a JIS-A hardness of 30° or greater, and a conductive resin layer superimposed over the conductive elastic layer and having a 10% elongation load of not more than 700 gf on a 1 cm wide section.

27 Claims, 3 Drawing Sheets

CONTACT CHARGER AND IMAGE FORMING APPARATUS PROVIDED WITH SAME

BACKGROUND OF THE INVENTION

1. Field of the Invention

The present invention relates to a contact charger and image forming apparatus provided with same, such as electrophotographic copying machines, printers, facsimile and the like.

2. Description of the Related Art

In image forming apparatus such as electrophotographic copying machines, printers, facsimiles and the like, the surface of an electrostatic latent image carrying member such as a photosensitive drum or the like is charged by means of a charging device. The charged region of said surface is subjected to image light exposure to form an electrostatic latent image thereon, said latent image is subsequently developed so as to be rendered visible, transferred onto a recording medium, and fixed on said recording medium.

Various types of such charging devices are known. Such chargers can be broadly divided into corona chargers which utilize a corona discharge via a corotron system, scorotron system, serrated electrode array system or the like, and contact chargers wherein a charging member such as a roller, brush, film, belt or the like is brought into contact with the surface of the electrostatic latent image carrying member.

Chargers that utilize a corona discharge are advantageous insofar as they provide stabilized charging, however they also have certain disadvantages in that they produce large amounts of ozone, which leads to deterioration of the electrostatic latent image carrying member, and adversely affects humans. Thus, attention has become focused on contact chargers which produce markedly less ozone compared to corona chargers.

Among the aforesaid charger types, contact charger having a roller configuration have been made practical via a function-separation construction having a conductive substrate, a conductive elastic layer formed on the conductive substrate and a conductive resin layer formed on the conductive elastic layer.

The conductive substrate provides a voltage supplying function to impart a high voltage to the entire roller, and a pressure imparting function for maintaining the contact between the roller and the electrostatic latent image carrying. member. The conductive elastic layer provides a current maintaining function to prevent voltage drops from the interior region of the roller to the exterior region thereof by a suitable electrical resistance value setting, and a cushion function for maintaining contact between the roller and latent image carrying member with a wide nip therebetween. The conductive resin layer provides a breakdown prevention function to prevent abnormal discharge of the roller in the defective areas of the latent image carrying member produced during manufacture via a suitable electrical resistance value setting, a release function to prevent adhesion of developer and dust, and a friction resistance function to prevent damage incurred via the rubbing with the latent image carrying member.

Contact chargers of the aforesaid roller type have been made practical in the area of low processing speed (peripheral speed of latent image carrying member). However, the contact charger of the roller type has not been made practical in the high speed area which is strongly desired for low ozone production, e.g., the area of 35 pages/minute and faster, in other words, in the area of the processing speed over 22 cm/second.

Contact chargers of the roller type having a conventional laminar construction are difficult to adapt to the high speed area due to the difficulty of assuring stable contact with the electrostatic latent image carrying member. That is, by randomly providing a conductive resin layer superimposed over a conductive elastic layer, the rotational speed of the roller is increased, and the conductive elastic layer which has a high degree of cushioning becomes deformed through contact with the latent image carrying member, such that the expansion of the conductive elastic layer protecting the surface of the roller cannot occur, and, consequently, a minute bounce begins to be generated by the roller which produces parallel striation-like image noise in the lengthwise direction of the roller. Simply increasing the pressure of the roller abutting the latent image carrying member to eliminate the problem of the aforesaid minute bounce of the roller readily produces image noise in the high-pressure contact area of the latent image carrying member, and leads to a further disadvantage inasmuch as the strength of the photosensitive member must be increased in relation to the high pressure used, thereby increasing cost of the photosensitive member.

SUMMARY OF THE INVENTION

A main object of the present invention is to provide a contact charger applicable to image forming apparatus capable of high-speed copying.

A further object of the present invention is to provide a contact charger applicable to image forming apparatus capable of high-speed copying without generating image noise at the area of contact with an electrostatic latent image carrying member.

These objects are accomplished by providing a contact charging device which charges the surface of a member moving at a high speed by contacting a charging member to the surface of said moving member, said charging member comprising:

- a conductive substrate;
- a conductive elastic layer provided on said conductive substrate and having a JIS-A hardness of 30° or greater; and
- a conductive resin layer provided on said conductive elastic layer and having a 10% elongation load of not more than 700 gf on a 1 cm wide section.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The preferred embodiments of the present invention are described hereinafter with reference to the accompanying drawings.

Figure 1:
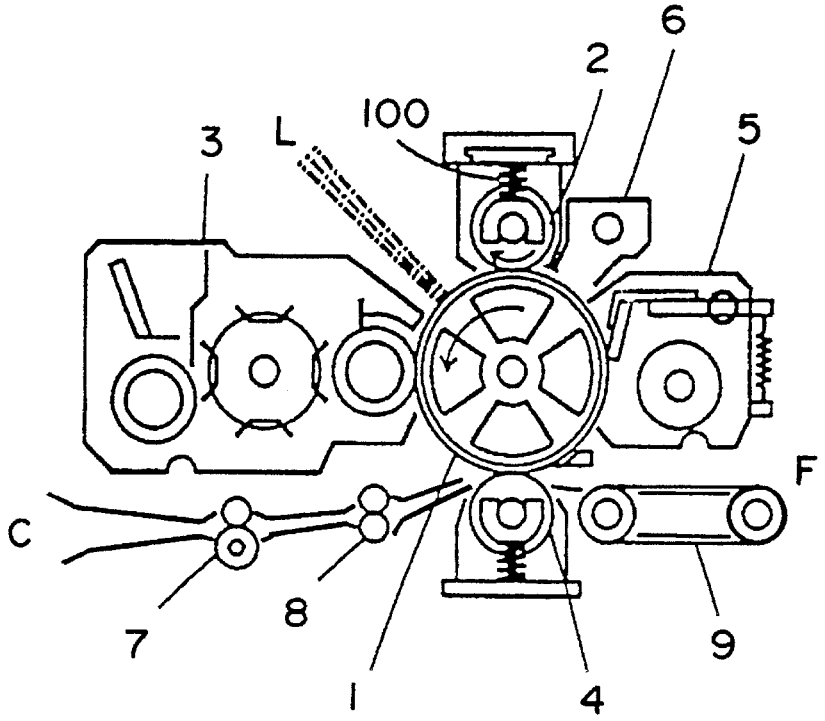
FIG. 1 is a brief construction view showing the essential portion of a copying apparatus incorporating a first embodiment of the contact charger of the present invention.

The embodiments of the invention described hereinafter are invariably incorporated in the copying apparatus, the essential portions of which are shown in FIG. 1. First, the copying apparatus shown in FIG. 1 is described below.

A photosensitive drum 1, i.e., an electrostatic latent image carrying member, is provided centrally in the copying apparatus of FIG. 1. This drum is rotatably driven in a counterclockwise direction in the drawing by a drive means which is not illustrated.

Arranged sequentially around the periphery of the aforesaid photosensitive drum 1 are charger 2, developing device 3, transfer charger 4, cleaning device 5, and eraser 6. Charger 2 is a charging device according to the present invention, the roller of which is drivable and makes contact with photosensitive drum 1 via coil spring 100, i.e., an urging means. The contact pressure is desirably 0.5~3.0 Kgf. When the contact pressure is less than 0.5 gf, it is difficult to achieve adequate contact, whereas a contact pressure greater than 3.0 Kgf readily generates image noise through said contact.

An optical unit (not shown in the drawing) is provided above photosensitive drum 1. This optical unit typically comprises an exposure lamp, reflective mirrors, optical lenses, slit and the like. Image exposure light is emitted from the aforesaid optical unit onto the surface of photosensitive drum 1 from position L indicated in the drawing.

Arranged sequentially to the left side of photosensitive drum 1 in the drawing are a pair of intermediate rollers 7, and a pair of timing rollers 8. Transfer sheets accommodated in a paper cassette not shown in the drawing are supplied from position C in FIG. 1.

In this copying apparatus, the surface of photosensitive drum 1 is uniformly charged to a predetermined potential by charger 2, and said charged surface is subjected to image exposure light emitted from the optical unit at position L so as to form an electrostatic latent image on said surface. The thus formed electrostatic latent image is developed by developing device 3 so as to form a toner image which is moved to a transfer region confronting transfer charger 4.

A copy sheet fed from position C passes through the pair of intermediate rollers 7 and arrives at the pair of timing rollers 8, and is subsequently transported to the transfer region synchronously with the toner image formed on the surface of photosensitive drum 1. At the transfer region, the toner image on the surface of photosensitive drum 1 is transferred onto the copy sheet by the action of transfer charger 4. After the toner image is fixed to the transfer sheet by a fixing device not shown in the drawing, the transfer sheet is discharged in the direction of position F.

After the toner image has been transferred onto the transfer sheet, the residual toner remaining on the surface of photosensitive drum 1 is removed therefrom by cleaning device 5, and the residual charge remaining on the surface of photosensitive drum 1 is discharged by eraser 6.

The system speed (peripheral speed of photosensitive drum 1) of the previously described copying apparatus is variable within the range of 22~60 cm/second. Developing device 3 is a normal two-component developing device.

The aforesaid photosensitive drum 1 is a negative-charge function-separated organic photosensitive member provided with superior sensitivity in the range of relative luminous efficiency.

Although the photosensitive member used in the present embodiment of the invention is the previously mentioned function-separated organic photosensitive member, it is to be understood that the invention is not limited to a photosensitive member of this type.

With regard to the range of sensitivity of the photosensitive member, the photosensitive member used desirably has a sensitivity in the long wavelength range in image forming systems using long wavelength light of a semiconductor laser (780 nm) optical system, LED array (680 nm) optical system or the like. For example, photosensitive members having sensitivity in the visible light range may be used in image forming systems using visible light as a light source such as liquid crystal shutter arrays, PLZT shutter array and the like, image forming systems using visible light laser as a light source, image forming system using a fluorescent light array as a light source, or analog image forming systems typical of copying apparatus which use visible light and lenses and mirrors in their optical system.

Although the previously mentioned photosensitive member may be constructed as a function-separated organic photosensitive member provided with a separate charge transporting layer superimposed over a charge generating layer, said photosensitive member may also be a photosensitive member of the so-called inverted layer type having the charge generating layer superimposed over the charge transporting layer, or may be a photosensitive member having a so-called monolayer construction wherein the charge generating function and charge transporting function are combined. Furthermore, the charge generating materials, charge transporting materials, bonding agents, additives and the like may be suitably selected from among well known materials according to purpose. Photosensitive materials are not limited to organic materials, inasmuch as various nonorganic materials may be used, e.g., zinc oxide, cadmium sulfide, selenium alloy, amorphous silicon alloy, amorphous germanium alloy and the like.

Photosensitive members suitable for the present embodiment of the invention may be provided with a surface overcoat layer to improve durability and resistance to environmental conditions, and may further be provided with an undercoat layer to improve charging characteristics, image quality, and bonding characteristics. Materials useful for the aforesaid overcoat layer or overcoat layer include, for example, resins such as ultraviolet-curing resins, cold-setting resins, thermoset resins and the like, and resins mixtures having resistance regulating material(s) dispersed in the aforesaid resins, thin-layer vacuum deposition materials such as metallic oxides, metallic sulfides and the like used to form a thin film in a vacuum by a vacuum deposition method, ion plating method or the like, and unshaped carbon film, unshaped silicon carbide film or the like manufactured using a plasma polymerization method.

The substrate materials for the photosensitive member applicable to the present. embodiment of the invention are not specifically limited to substrates having an electrically conductive surface, and may be of a shape other than cylindrical such as plate-shaped or belt-shaped. The surface of the substrate may be subjected to treatment by roughening process, oxidation process, coloring process and the like.

The toner used in the previously mentioned developing device 3 is an unshaped styrene-acrylic toner of a positive-charge type.

Although the developer used in the present embodiment comprises a positive-charge type, unshaped black toner and carrier, it is to be understood that developers applicable to the embodiments of the invention are not limited to this type of developer. Negative-charge toners, translucent toners, magnetic toners, iron powder carriers, binder type carriers, resin-coated carriers, monocomponent developing methods, reversal developing methods and the like may be used as appropriate in accordance with the polarity of the photosensitive member and image forming process being used.

Toner color is not limited to black, and yellow, magenta, and cyan color toners may be selected as suitable. Usable toner is not limited to unshaped toners, insofar as toners of defined shaped may also be used, e.g., spherical toners, crystal form toners and the like. Usable carriers are not limited to powders insofar as the selected carrier possesses the characteristics required for the developing systems such as conductive brushes, conductive rollers and the like. Furthermore, the developer used may incorporate lubricants such as, for example, bis or powders such as vinylidene polyfluoride resin, teflon resin, PMMA resin or the like to improve flow characteristics and cleaning properties.

Figure 2:
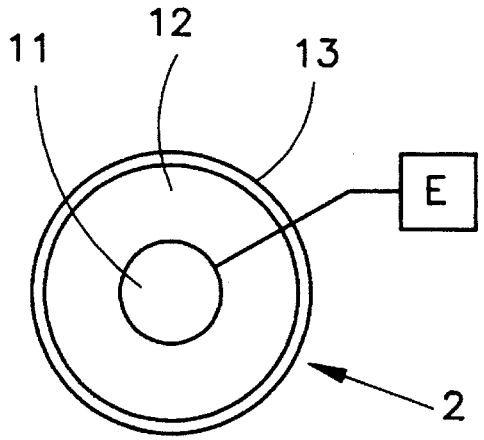
FIG. 2 is a transverse section view showing the basic construction of the contact charger of the first embodiment.
Figure 3:
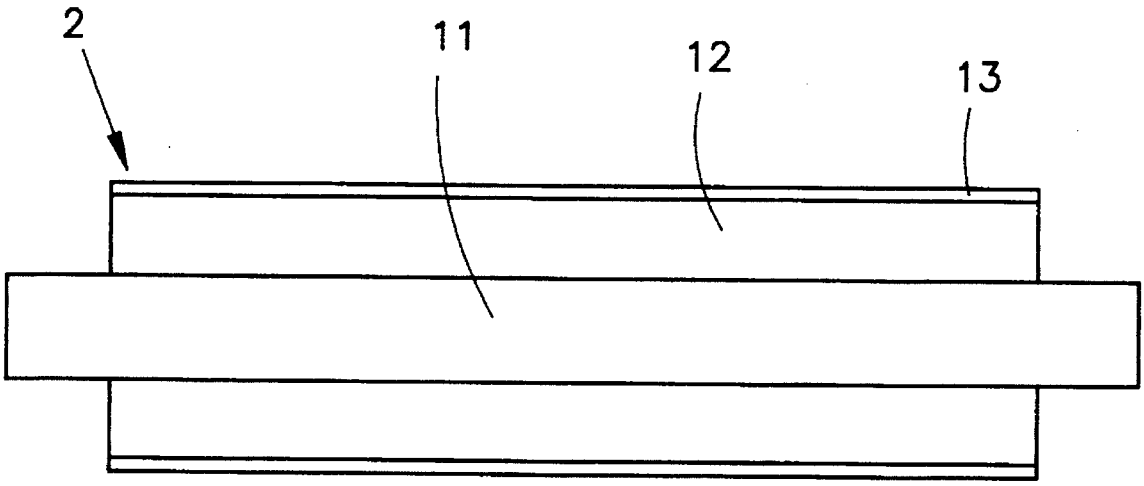
FIG. 3 is a longitudinal section view showing the basic construction of the contact charger of the first embodiment.

The basic construction of a first embodiment of charger 2 in the previously described copying apparatus is described hereinafter with reference to FIGS. 2 and 3. FIG. 2 is a transverse section view of charger 2, and FIG. 3 is a longitudinal section view of charger 2. Charger 2 has a laminate construction comprising conductive elastic layer 12 superimposed over conductive substrate 11, with conductive resin layer 13 superimposed over said conductive elastic layer 12.

A suitable charging voltage is applied to conductive substrate 11 by a power source not shown in the illustrations. For example, a direct current (DC) voltage at an absolute value of 0.8~2.0 kV may be applied. Alternatively, an alternating current (AC) of identical voltage may be suitably overlaid.

In the present invention, a 10% elongation load on a 1 cm wide section of the conductive resin layer is, in general, preferably not more than 700 gf, and preferably not more than 500 gf. Although the lower limit of the 10% elongation load on a 1 cm wide section is not specifically limited, in general, a load of 30 gf or greater, and preferably 100 gf or greater is preferred to maintain mechanical strength (to prevent damage to or breakdown of the conductive resin layer) for use in a contact charger.

Useful materials as the conductive substrate of the contact charger of the present invention include, for example, metallic materials such as iron, SUS, aluminum, copper, chrome, titanium and the like.

Examples of useful materials for the conductive elastic layer of the contact charger are natural rubber, styrene-butadiene rubber, nitrile rubber, chloroprene rubber, butyl rubber, ethylene-propylene rubber, chlorosulfonated polyethylene, silicone rubber, fluororubber, urethane rubber, chlorinated polyethylene, acrylic rubber, epichlorohydrin rubber, polybutadiene, polyisoprene and like rubbers in which are dispersed powder-shaped or fiber-shaped conductive carbon, iron, aluminum, copper, chrome, titanium, tin, zinc, gold, silver, cobalt, lead, platinum and like metals, metallic oxides such as antimony oxide, indium oxide, molybdenum oxide, and conductive polymers such as polyacetylene, polypyrole, polythiophene and the like.

Examples of useful materials for the conductive resin layer of the contact charger are plastic film materials such as polyethylene, polypropylene, ionomer, polyvinyl alcohol, polyvinyl acetate, ethylene-vinyl acetate copolymer, poly-4-methylpentene-1, polymethyl methacrylate, polycarbonate, polystyrene, acrylonitrile-methyl acrylate copolymer, acrylionitrile-butadiene-styrene copolymer, polyethylene terephthalate, polyurethane elastomer, cellulose nitrate, cellulose acetate, cellulose triacetate, cellulose propionate, cellulose acetate butyrate, ethyl cellulose, regenerated cellulose, nylon 6, nylon 66, nylon 11, nylon 12, polyamide, polysulfon, polyether sulfon, polyvinyl chloride, vinyl chloride-vinyl acetate copolymer, polyvinylidene chloride, vinylidene chloride-vinyl chloride copolymer, vinyl-nitrile rubber metal, polytetrafluoroethylene, polychlorotrifluoroethylene, polyvinyl fluoride, polyvinylidene fluoride, and the like in which are dispersed powder-shaped or fiber-shaped conductive carbon, iron, aluminum, copper, chrome, titanium, tin, zinc, gold, silver, cobalt, lead, platinum and like metals, metallic oxides such as antimony oxide, indium oxide, molybdenum oxide, and conductive polymers such as polyacetylene, polypyrole, polythiophene and the like.

Figure 4:
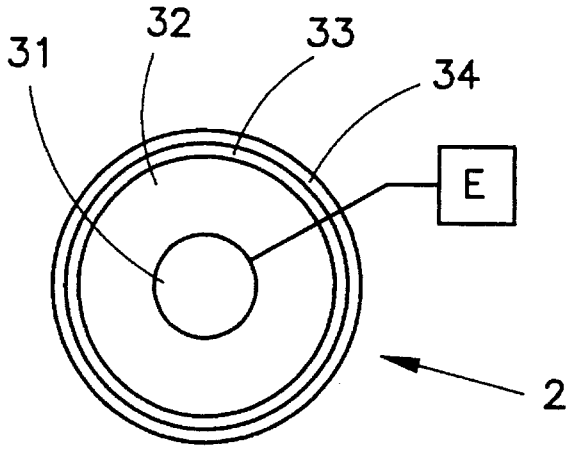
FIG. 4 is a transverse section view showing the construction of the contact charger of the second embodiment.
Figure 5:
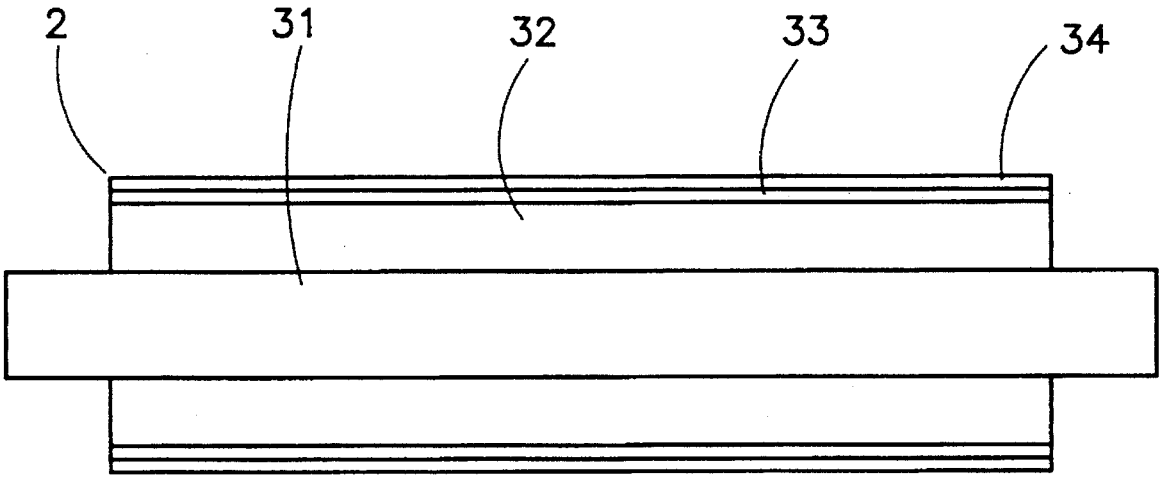
FIG. 5 is a longitudinal section view showing the construction of the contact charger of the second embodiment.

As shown in FIGS. 4 and 5, the conductive resin layer may be constructed of two or more types of materials, and may have two or more layers. Films of this type may be formed using an application method, tube forming method, heat-shrink tube method and the like.

Electrical resistivity of the conductive elastic layer in the aforesaid contact charger is preferably not more than $10^6$ Ωcm to prevent voltage drops. The thickness of the conductive elastic layer is not specifically limited if within a range that does not problematic relative to installation and handling relative to the overall size of contact charger and has a hardness of JIS-A of 30°, but in general a thickness of about 0.5~30 mm may be considered.

Electrical resistivity of the conductive resin layer in the aforesaid contact charger is preferably $10^7$ Ωcm or greater but not more than 10~Ωcm. When electrical resistivity is less than $10^7$ Ωcm, it is difficult to prevent abnormal discharge of the roller in the defects produced during manufacture of the electrostatic latent image carrying member. When electrical resistivity is greater than $10^{11}$ Ωcm, discharge is readily interrupted by charge accumulation during discharge on the surface of the conductive resin layer. Although the thickness of the conductive resin layer is not specifically limited, it may be about 10~500 μm in consideration of durability and forming characteristics.

The construction of a second embodiment of charger 2 in the previously described copying apparatus is described hereinafter with reference to FIGS. 4 and 5. FIG. 4 shows a transverse section view of charger 2; FIG. 5 shows a longitudinal section view of charger 2. The aforesaid charger 2 comprises sequential laminations of conductive elastic layer 32 superimposed over conductive substrate 31, conductive resin inner layer 33 superimposed over said conductive elastic layer 32, and conductive resin outer layer 34 superimposed over said conductive resin inner layer 33.

Experiments using a copying apparatus as shown in FIG. 1 and provided with charger 2 of the first embodiment and charger 2 of the second embodiment are described hereinafter.

A photosensitive member of the function-separated type manufactured by the method described below was used as photosensitive drum 1.

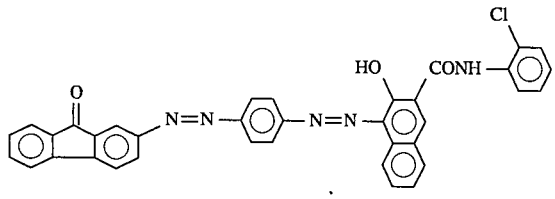

Loaded into a sand grinder were 0.45 parts-by-weight (pbw) azo compound having the chemical structure shown in the equation above, 0.45 pbw polyester resin (Bairon 200; Toyobo Co., Ltd.), and 50 pbw cyclohexanone, which was dispersed for a 24 hour period to obtain a photosensitive application fluid. At this time, the photosensitive application fluid had a viscosity of 20 cp at 20° C. The application fluid was applied by a dipping method to the surface of a cylindrical aluminum substrate the surface of which was pretreated by a "bite" machining process so as to form, after drying, a charge generating layer having a thickness of 0.3 μm. The cylindrical substrate was an aluminum alloy having 0.7 percent-by-weight magnesium, and 0.4 percent-by-weight silicon. Drying conditions were circulating air at 20° C. for 30 minutes.

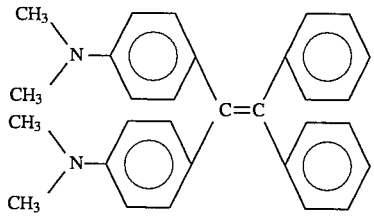

Applied over the aforesaid charge generating layer by a dipping method was an application of a fluid comprising 10 pbw styryl compound having the chemical structure shown in the equation above, 7 pbw polycarbonate (Panlite K-1300; Teijin Kasei K. K.) dissolved in a solvent having 40 pbw 1,4-dioxane so as to form, after drying, a charge transporting layer having a thickness of 32 μm. At this time, the viscosity of the fluid was 240 cp at 20° C. Drying conditions were circulating air at 100° C. for 30 minutes.

The toner manufacturing method is described hereinafter.

First, 8 pbw carbon black (Mogul-L; Cabot, Co.), 5 pbw nigrosine stain (Bontron N-01; Orient Chemical Co.), and 3 pbw non-polar polypropylene (605P; Sanyo Kasei K. K.) were adequately mixed with 100 pbw styrene-n-butyl-methacrylate resin (softening point: 132° C., glass transition temperature: 60° C.) using a ball mill. Then, this mixture was adequately mixed by three rollers heated to 140° C., and after the mixture was allowed to stand to cool, it was coarsely pulverized, followed by fine pulverization using a jet mill. The finely pulverized material was subjected to air classification, to obtain unshaped, positive-charge. toner having a mean particle diameter of 7.5 μm. This toner was then subjected to a post-process of mixing 100 pbw of said toner with 0.2 pbw hydrophobic silica(R-974); Nippon Aerosil Co., Ltd.) using a Henschel mixer to impart flow characteristics.

The aforesaid toner was mixed with carrier particles, and loaded in the previously mentioned developing device 3 for use as a developer. The carrier manufacturing method is described hereinafter.

First, 2 pbw carbon black (MA#8; Mitsubishi Kasei Kogyo K. K.) and 300 pbw magnetic powder (MFP-2; TDK K. K.) were added to 100 pbw polyester resin (Tafuton NE 1110; Kao K. K.) and adequately mixed using a Henschel mixer. The derived material was further mixed by biaxial extruder, and after cooling, was coarsely pulverized. The coarsely pulverized material was finely pulverized by a jet mill pulverizer, and air classified to obtain fine polymer particles incorporating magnetic powder and having a mean particle diameter of 2 μm.

Then, 10 pbw of the aforesaid fine polymer particles incorporating magnetic powder were added to 100 pbw ferrite particles F-250HR (mean particle diameter: 50 μm; Powder-tekku K. K.) and processed in an Ang mill AAM-20F (Hosokawa Micron Co.) at 2,500 rpm for 40 minutes to obtain a carrier intermediate product having a mean particle diameter of 55 μm. The carrier intermediate product was subjected to a heating process at 400° C. using a suffusion system (Nippon Pneumatic Mfg. Co., Ltd.) to obtain a carrier having a mean particle size of 55 μm.

After the previously described toner and carrier were mixed to achieve a toner density of 7 percent-by-weight, the resulting developer was loaded in the previously mentioned developing device 3. Image formation was accomplished while maintaining toner density at 7±1 percent-by-weight by means of a toner resupply unit and toner density sensor not shown in the drawings.

The method of manufacturing the charger of the first embodiment is described hereinafter.

A metal shaft made of SUS 303 and having a diameter of 8 mm was used as conductive substrate 11.

A conductive elastic layer 12 comprising a rubber layer formed mainly of ethylene propylene rubber and having a thickness of 5 mm was superimposed over the aforesaid conductive substrate 11. The ethylene propylene rubber material may be formed in a roller configuration by normal rubber forming methods such as, for example, kneading, formulation, mixing, curing, warm-up, sitting, molding, clamping, vulcanization, cooling by standing, polishing and the like. At this time, a conduction agent comprising mainly conductive carbon, and a plasticizer comprising mainly dioctylphthalate were suitably adjusted during formulation, to obtain samples which, after formation, had an electrical resistivity of $2\times10^5$ Ωcm and JIS-A hardness of 30° and 22°, respectively.

Then, a resin tube manufactured by a tube molding process was superimposed over conductive elastic layer 12 as conductive resin layer 13. Polyvinyl chloride film manufactured by an inflation process was used as the tubing material. The internal diameter of the tube was 17.5 mm at installation; an external tube attachment method was used wherein as the tube was inflated by air pressure, it was inserted on the roller comprising conductive elastic layer 12 superimposed over conductive substrate 11 and having a diameter of 18 mm.

The samples of polyvinyl chloride films used for conductive resin layer 13 were manufactured to achieve 10% elongation loads of 30 gf, 100 gf, 300 gf, 500 gf, and 700 gf per 1 m wide section and with an electrical resistivity of $3\times10^8$ Ωcm by adjusting the type and added amount of conductive carbon fine particles mixed in the film materials to control resistance, and type and added amount of plasticizer added to control elongation, as well as controlling film thickness and mixing conditions and inflations conditions of the materials. Reference samples were manufactured separately in the same way to achieve 10% elongation loads of 10 gf and 900 gf, respectively. The measurement methods described below were used to determine 10% elongation load per 1 cm wide section of conductive resin layer 13.

Charger 2 manufactured as previously described and comprising sequential laminations of conductive elastic layer 12 superimposed over conductive substrate 11, and conductive resin layer 13 superimposed over said conductive elastic layer 12, has notches introduced to the conductive resin layer portion by a suitable cutting tool to allow removal of sample sections of the conductive resin layer measuring 1 cm in width by 6 cm in length. A 5 mm portion was chocked from bilateral ends of the section in the lengthwise direction, and a tension load was applied to the 1×5 cm section in the lengthwise direction. At this time, the load at 5 mm was determined at 10% elongation of the sample relative to the measured length of 5 cm, and said load was designated the 10% elongation load Fgf per 1 cm wide section of conductive resin layer 13 of charger 2.

When sample sections of the conductive resin layer could not be collected in the aforesaid dimensions due to conditions of the materials, the 10% elongation load Fgf per 1 cm wide section was determined using a rectangular section width Wcm, elongated sample section length Lcm, elongation load Tgf, and elongated sample section length L'cm with the elongation load in the applied state via Equation (1) below:

$$F = Tx\frac{1}{W} \times \frac{10}{100x(L' - L)/L}$$

When sampling the test materials, JIS-A hardness was measured for the conductive elastic layer after collecting the conductive resin layer section. The measured hardness value of the conductive elastic layer was verified to be not more than 30°, and the conductive resin layer was verified to be sampled per the essence of the present invention. When a tubing material was used as the conductive resin layer, it is possible to determine the direct elongation load of the tubing material prior to the external tube attachment process; however, since changes in the elongation load occurring during transformation of the materials during the external tube attachment process, a method was used in the present evaluations wherein conductive resin layer section were collected from the materials in their final configuration.

The charger manufacturing method of the second embodiment is described hereinafter.

Characteristic of the second embodiment is a multiple layer construction comprising an inner layer and an outer layer for the conductive resin layer. Specifically, charger 2 was manufactured by providing sequential laminations of a metal shaft made of SUS 303 and having a diameter of 8 mm identical to that of the first embodiment was used as conductive substrate 31, and a rubber layer composed primarily ethylene-propylene rubber and having a JIS-A hardness of 30° and 22° with a thickness of 5 mm and identical to those of the first embodiment were used as conductive resin layer 32, and a polyvinyl chloride film manufactured by the previously described method was used as conductive resin layer 33, and an ethylene tetrafluoride resin layer was used as conductive resin layer 34. The aforesaid ethylene tetrafluoride resin layer was manufactured by spreading an application of a commercial ethylene tetrafluoride resin fluid (Emuraron 345; Achison Japan K. K.) at a fluid viscosity of 250~300 cp, and subsequently drying the application at 100~160° C. for 30~120 minutes.

Polyvinyl chloride tubing was manufactured under the previously described conditions so as to achieve an electrical resistivity of $3\times10^8$ Ωcm overall on the conductive resin layer having a two-layer construction, and 10% elongation loads of 30 gf, 100 gf, 300 gf, 500 gf, and 700 gf per 1 m wide section by adjusting said manufacturing conditions, application viscosity drying temperature, drying time, spreading conditions, and layer thickness of the ethylene tetrafluoride resin layer. Reference samples were manufactured identically but had 10% elongation loads of 10 gf and 900 gf per 1 m wide section. The chargers 2 of the first and second embodiments manufactured as previously described were installed in a copying apparatus having the essential construction shown in FIG. 1. Image formation and image quality evaluations were conducted. The evaluation methods are specifically described below.

Charger 2 was brought into contact with photosensitive member 1 at a pressure of 2 kg so as to not produce adverse effects. The rotational speed of the photosensitive member, i.e., the peripheral speed of the rotationally driven charger 2, was selectably 22 cm/sec, 38 cm/sec, 60 cm/sec within the normal range of a high-speed copying apparatus, and the applied voltage was adjusted within a range of −1.0~−1.2 kV so as to achieve an initial charge of −600 V on the surface of the photosensitive member. A commercial surface potentiometer (Surface potentiometer model 344; Trek Co.) was used to measure the surface potential of the photosensitive member at this time.

After a half original document having a density of 0.4 was placed on the document platen and exposed from position L in FIG. 1, the latent image was developed by developing device 3, and the produced toner image was transferred to a copy sheet of density 0.03, whereupon the image sample was used for evaluation. At this time, the amount of exposure was suitably adjusted so as to achieve a maximum image density value of 1.0 by the image density evaluation described below.

The obtained image samples were measured for image density using a commercial image densitometer (Sakura Microdensitometer model PDM-5, type BR; Konica), under these conditions: 50-fold magnification; scanning speed: 50 μm/sec; measured area: 10 $\mu m^2$; for a length of 10 cm in the scanning direction relative to the circumferential direction of the photosensitive member. At this time, the image density was derived from the maximum measured image density (1.0) and minimum image density, and was used for function evaluation.

Image samples within an image density difference of 0.2 were designated images for which image density irregularities due to roller looseness could not be visually recognized, and were given rank A in the evaluation. Although slight irregularity was visible, image samples having an image density difference in excess of 0.2 but not more than 0.35 were designated images which posed no practical problem with respect to image density irregularities due to roller looseness, and were given rank B. Image samples having an image density difference in excess of 0.35 were designated inappropriate for practical use since image density irregularities could be visually recognized, and were given rank C.

Durability tests were conducted for the copying apparatus having the essential construction shown in FIG. 1 by making 80,000 copies on A4 size paper to vevaluate the durability of charger 2. The surface of charger 2 was examined using an optical microscope before and after the durability tests. Chargers with adequate durability which did not exhibit morphological changes on the surface were given rank X. Chargers exhibiting minute cracks but which had not exposure of the conductive elastic layer were given rank Y. Chargers exhibiting some peeling and exposure of the conductive elastic layer were given rank Z.

Table 1 shows evaluation results for charger 2 of the first embodiment wherein the conductive resin layer is a monolayer as shown in FIGS. 2 and 3. Table 2 shows evaluation results charger 2 of the second embodiment wherein the conductive resin layer has a multilayer construction as shown in FIGS. 4 and 5. The elongation load is the 10% elongation load per 1 cm wide section of the conductive resin layer.

TABLE 1

| | | Charger rotational speed (cm/sec) | | | | | |
|---|---|---|---|---|---|---|---|
| | | 20 | | 40 | | 60 | |
| | | Conductive elastic layer JIS-A hardness | | | | | |
| | | 30° | 22° | 30° | 22° | 30° | 22° |
| Elongation Load (gf) | 10 | A-Y | A-Z | A-Z | A-Z | A-Z | A-Z |
| | 30 | A-Y | A-Y | A-Y | A-Y | A-Y | A-Y |
| | 100 | A-X | A-X | A-X | A-X | A-X | A-X |
| | 300 | A-X | A-X | A-X | A-X | A-X | A-X |
| | 500 | A-X | A-X | A-X | A-X | A-X | A-X |
| | 700 | A-X | B-X | B-X | B-X | B-X | B-X |
| | 900 | A-X | C-X | C-X | C-X | C-X | C-X |

TABLE 2

| | | Charger rotational speed (cm/sec) | | | | | |
|---|---|---|---|---|---|---|---|
| | | 20 | | 40 | | 60 | |
| | | Conductive elastic layer JIS-A hardness | | | | | |
| | | 30° | 22° | 30° | 22° | 30° | 22° |
| Elongation Load (gf) | 10 | A-Y | A-Z | A-Y | A-Z | A-Z | A-Z |
| | 30 | A-Y | A-Y | A-Y | A-Y | A-Y | A-Y |
| | 100 | A-X | A-X | A-X | A-X | A-X | A-X |
| | 300 | A-X | A-X | A-X | A-X | A-X | A-X |
| | 500 | A-X | A-X | A-X | A-X | A-X | A-X |
| | 700 | A-X | B-X | B-X | B-X | B-X | B-X |
| | 900 | C-X | C-X | C-X | C-X | C-X | C-X |

It can be understood from the above results that contact chargers of a roller type having a conductive elastic layer of a JIS-A hardness of less than 30° superimposed over a conductive substrate and operating in the high-speed range with a peripheral speed of 20 cm/sec or greater can produce images without problems from a practical standpoint relative to image density irregularities due to roller looseness as indicated by rank A and B, by providing a conductive resin layer having a 10% elongation load of 700 gf or less per 1 cm wide section superimposed over a conductive elastic layer whether or not the conductive resin layer has a monolayer or multilayer construction. When a conductive resin layer is provided 10% elongation load of less than 500 gf per 1 cm wide section, suitable images were obtained as indicated by the rank A for image density irregularity due to roller looseness, whether or not the conductive resin layer has a monolayer or multilayer construction.

On the other hand, it can be understood that chargers having roller surface morphologies achieving rankings of X and Y after durability testing posed no practical problems by providing a conductive resin layer having a 10% elongation load greater than 30 gf per 1 cm wide section, whether or not the conductive resin layer has a monolayer or multilayer construction. It can be further understood that suitable characteristics are also provided by chargers achieving a rank of X after durability testing by providing a conductive resin layer having a 10% elongation load greater than 100 gf per 1 cm wide section, whether or not the conductive resin layer has a monolayer or multilayer construction.

Figure 6:
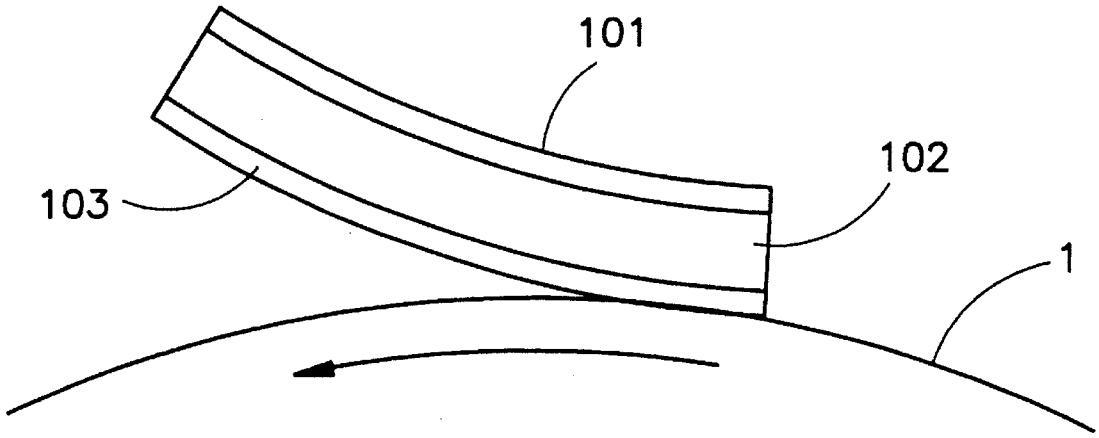
FIG. 6 is a transverse section view showing the construction of the contact charger of the third embodiment.

Although the first and second embodiments have been described in terms of a contact charger with a rotating roller configuration, it is to be understood that the present invention is not limited to such a configuration. A third embodiment shown in FIG. 6 provides a charger having a edge-supported morphology comprising a conductive elastic layer 102 with JIS-A hardness of 30° superimposed over a blade-like conductive substrate 101, and a conductive resin layer 103 having a 10% elongation load of not more than 700 gf per 1 cm wide section superimposed over said layer 102. Moreover, the charger of the present invention may be used as a transfer charger.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. In a charging device which charges a surface of a member moving at a high speed by contacting a charging member to the surface of said moving member, said charging member comprising:

a conductive substrate;

a conductive elastic layer provided on said conductive substrate and having a JIS-A hardness of 30° or greater; and a conductive resin layer provided on said conductive elastic layer and having a 10% elongation load of not more than 700 gf on a 1 cm wide section.

2. A charging device as claimed in claim 1 wherein said charging member is a rotatable roller which is in pressing contact with said moving member.

3. A charging device as claimed in claim 1 wherein said charging member is a blade which is in pressing contact with the moving member.

4. A charging device as claimed in claim 1 wherein said conductive substrate is formed of metallic materials.

5. A charging device as claimed in claim 1 wherein said conductive elastic layer is formed of rubbers in which are dispersed powder-shaped or fiber-shaped conductive carbon, metals, metallic oxides, and conductive polymers.

6. A charging device as claimed in claim 1 wherein said conductive resin layer is formed of plastic film materials in which are dispersed powder-shaped or fiber-shaped conductive carbon, metals, metallic oxides, and conductive polymers.

7. A charging device as claimed in claim 1 wherein said conductive elastic layer has electrical resistivity of not more than $10^6$ Ωcm and has a thickness of about 0.5–30 mm.

8. A charging device as claimed in claim 1 wherein said conductive resin layer has electrical resistivity of $10^7$ Ωcm or greater but not more than $10^{11}$ Ωcm and has a thickness of 10–500 μm.

9. A charging device as claimed in claim 1, wherein the surface of the member moves at at least 22 cm/second.

10. A charging device as claimed in claim 1, wherein the conductive resin layer is an outermost layer of the charging member.

11. An image forming apparatus comprising:

an electrostatic latent image carrying member which rotates at high speed; and a charging member which charges a surface of said electrostatic latent image carrying member by being contacted to the surface of the rotating image carrier, said charging member having a conductive substrate, conductive elastic layer provided on said conductive substrate and having a JIS-A hardness of 30° or greater, and a conductive resin layer provided on said elastic layer and having a 10% elongation load of not more than 700 gf on a 1 cm wide section.

12. An image forming apparatus as claimed in claim 11 wherein said charging member is a rotatable roller which is in pressing contact with the electrostatic latent image carrying member.

13. An image forming apparatus as claimed in claim 11 wherein said charging member is a blade which is in pressing contact with the electrostatic latent image carrying member.

14. An image forming apparatus as claimed in claim 11 wherein said conductive substrate is formed of metallic materials.

15. An image forming apparatus as claimed in claim 11 wherein said conductive elastic layer is formed of rubbers in which are dispersed powder-shaped or fiber-shaped conductive carbon, metals, metallic oxides, and conductive polymers.

16. An image forming apparatus as claimed in claim 11 wherein said conductive resin layer is formed of plastic film materials in which are dispersed powder-shaped or fiber-shaped conductive carbon, metals, metallic oxides, and conductive polymers.

17. An image forming apparatus as claimed in claim 11 wherein said conductive elastic layer has electrical resistivity of not more than $10^6$ Ωcm and has a thickness of about 0.5–30 mm.

18. An image forming apparatus as claimed in claim 11 wherein said conductive resin layer has electrical resistivity of $10^7$ Ωcm or greater but not more than $10^{11}$ Ωcm and has a thickness of 10–500 μm.

19. An image forming apparatus as claimed in claim 11, wherein the surface moves at at least 22 cm/second.

20. A charging device as claimed in claim 11, wherein the, conductive resin layer is an outermost layer of the charging member.

21. A charging device which charges a surface of a member moving at a high speed, said charging device comprising:

a substrate which is formed of a conductive metal;

an elastic layer provided on said substrate and including a ethylene propylene rubber and a conduction agent; and a resin layer provided on said elastic layer and including polyvinyl chloride film and a conductive agent.

22. A charging device as claimed in claim 21 further comprising:

a second resin layer provided on said resin layer and including an ethylene tetrafluoride resin layer.

23. A charging device as claimed in claim 21, wherein the surface of the member moves at at least 22 cm/second.

24. A charging device of claim 21, wherein the resin layer is an outermost layer of said charging device.

25. A method for charging a surface of an electrostatic latent image carrying member which rotates at a high speed, said method comprising:

providing a charging member which has a conductive substrate, a conductive elastic layer provided on said conductive substrate and having a JIS-A hardness of 30° or greater, and a conductive resin layer provided on said elastic layer and having a 10% elongation load of not more than 700 gf on a 1 cm wide section;

applying a predetermined voltage to said conductive substrate; and charging the surface of the electrostatic latent image carrying member by contacting the charging member to the surface of the electrostatic latent image carrying member.

26. The method of claim 25, wherein an image forming apparatus surface moves at at least 22 cm/second.

27. The method of claim 25, wherein the conductive resin layer is an outermost layer of the charging member.

* * * * *